US009731498B2

(12) United States Patent
Feygelman et al.

(10) Patent No.: US 9,731,498 B2
(45) Date of Patent: Aug. 15, 2017

(54) TO APPLY A FLUID TO A SUBSTRATE

(71) Applicant: Hewlett-Packard Indigo, B.V., Amstelveen (NL)

(72) Inventors: Alex Feygelman, Ness Ziona (IL); Zvika Cohen, Ness Ziona (IL); Mordechai Arenson, Ness Ziona (IL); Ziv Yosef, Ness Ziona (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 0 days.

(21) Appl. No.: 15/032,244

(22) PCT Filed: Oct. 28, 2013

(86) PCT No.: PCT/EP2013/072525

§ 371 (c)(1),
(2) Date: Apr. 26, 2016

(87) PCT Pub. No.: WO2015/062625

PCT Pub. Date: May 7, 2015

(65) Prior Publication Data

US 2016/0271933 A1 Sep. 22, 2016

(51) Int. Cl.

| | |
|---|---|
| ***B41F 35/00*** | (2006.01) |
| ***B41F 22/00*** | (2006.01) |
| ***B41F 19/00*** | (2006.01) |
| ***B41F 13/18*** | (2006.01) |
| ***B41F 21/00*** | (2006.01) |
| ***B41F 23/00*** | (2006.01) |
| ***B41F 23/04*** | (2006.01) |

(52) U.S. Cl.

CPC ..... *B41F 22/00* (2013.01); *B41F 13/18* (2013.01); *B41F 19/001* (2013.01); *B41F 21/00* (2013.01); *B41F 23/00* (2013.01); *B41F 23/04* (2013.01); *B41F 23/0486* (2013.01); *B41P 2217/11* (2013.01)

(58) Field of Classification Search

CPC ..... B41F 22/00
USPC ..... 101/424.2
See application file for complete search history.

(56) References Cited

U.S. PATENT DOCUMENTS 3,975,242 A * 8/1976 Matsuda ..... C25D 7/0614 204/206
4,688,784 A * 8/1987 Wirz ..... B41F 22/00 101/420
5,136,973 A 8/1992 Nies et al.
(Continued)

FOREIGN PATENT DOCUMENTS

GB 533089 2/1941

OTHER PUBLICATIONS

Ilia V Roisman, et al., "Multiple Drop Impact Onto a Dry Solid Substrate", Journal of Colloid and Interface Science, vol. 256, Issue 2, Dec. 15, 2002, pp. 396-410.
(Continued)

*Primary Examiner* — Anthony Nguyen
(74) *Attorney, Agent, or Firm* — HP Inc. Patent Department

(57) ABSTRACT

Apparatus to apply a fluid to a substrate, the apparatus includes a first roller to rotate about an axis and apply a fluid to a first side of the substrate. The first roller includes an outlet to provide gas to the substrate to guide the movement of the substrate subsequent to the application of fluid to the substrate.

13 Claims, 8 Drawing Sheets

(56) References Cited

U.S. PATENT DOCUMENTS

| | | | | |
|---|---|---|---|---|
| 5,524,363 | A * | 6/1996 | Seidl | F26B 13/104 34/629 |
| 5,564,692 | A * | 10/1996 | Lotsch | B41F 22/00 101/420 |
| 5,823,112 | A * | 10/1998 | Platsch | B41F 23/06 101/424.2 |
| 6,058,844 | A | 5/2000 | Niemiec | |
| 6,308,620 | B1 * | 10/2001 | Wadlinger | B41F 22/00 101/183 |
| 6,912,952 | B1 * | 7/2005 | Landa | G03G 15/234 101/229 |
| 8,485,126 | B2 | 7/2013 | Miyamoto et al. | |
| 2003/0205153 | A1 | 11/2003 | Wadlinger et al. | |
| 2010/0064917 | A1 * | 3/2010 | Blanchard | B41F 13/02 101/226 |
| 2012/0135135 | A1 | 5/2012 | Sakurai et al. | |

OTHER PUBLICATIONS

International Search Report and Written Opinion dated Jul. 7, 2014, PCT Patent Application No. PCT/EP2013/072525 filed Oct. 28, 2013, European Patent Office.

* cited by examiner

TO APPLY A FLUID TO A SUBSTRATE

CLAIM FOR PRIORITY

The present application is a national stage filing under 35 U.S.C. §371 of PCT application number PCT/EP2013/072525, having an international filing date of Oct. 28, 2013, the disclosure of which is hereby incorporated by reference in its entirety.

BACKGROUND

Printer apparatus may be arranged to apply a fluid to a substrate. For example, a printer apparatus may be arranged to coat a substrate with a priming fluid to improve printing quality. In other examples, a printer apparatus may be arranged to print ink on a substrate. In further examples, a printer apparatus may be arranged to apply a post-printing fluid (such as varnish) to a substrate.

BRIEF DESCRIPTION

Reference will now be made by way of example only to the accompanying drawings in which.

DETAILED DESCRIPTION

Figure 1:
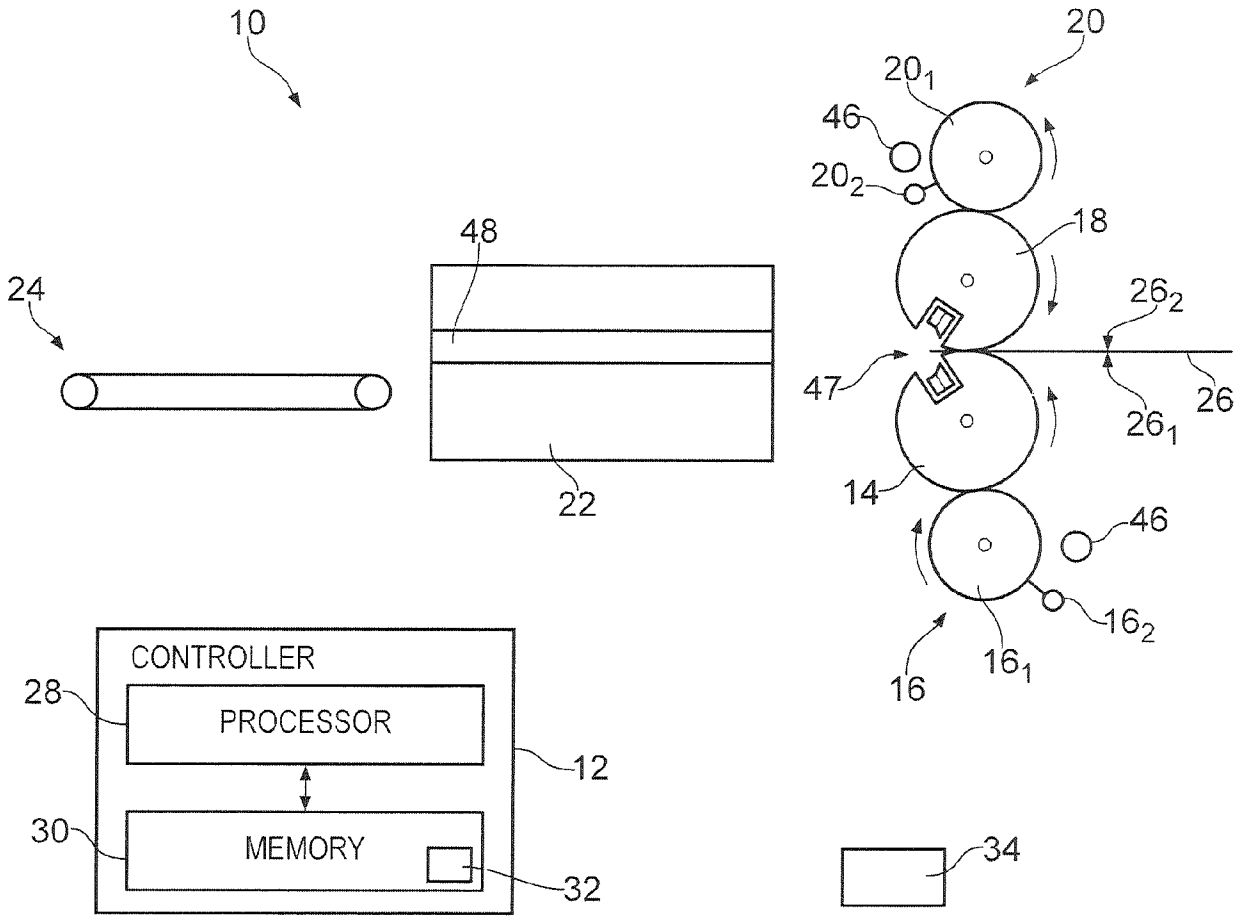
FIG. 1 illustrates a schematic diagram of apparatus to apply a fluid to a substrate according to an example.

FIG. 1 illustrates a schematic diagram of apparatus 10 including a controller 12, a first roller 14, a first fluid applicator 16, a second roller 18, a second fluid applicator 20, a guide module 22 and a conveyor 24. The apparatus 10 is arranged to apply a fluid to a substrate 26. The fluid may be a pre-printing fluid such as primer, or a post-printing fluid such as varnish.

The apparatus 10 may form at least part of a printer or may be a separate device to a printer. For example, where the apparatus 10 is arranged to coat the substrate 26 with a primer, the apparatus 10 may be referred to as a priming apparatus, and the apparatus 10 may or may not be a separate device to a printer.

In some examples, the apparatus 10 may be a module. As used here, 'module' refers to a unit or apparatus that excludes certain parts/components that would be added by an end manufacturer or a user. For example, where the apparatus 10 is a module, the apparatus 10 may only include the first roller 14 and the remaining components may be added by another manufacturer. By way of another example, where the apparatus 10 is a module, the apparatus 10 may only include the controller 12 and the remaining components may be added by another manufacturer.

The substrate 26 may be a sheet of media (such as paper). The substrate 26 has a first side $\mathbf{26}_1$ and a second side $\mathbf{26}_2$. In some examples, the apparatus 10 may be arranged to apply fluid to only the first side $\mathbf{26}_1$ of the substrate 26. In other examples, the apparatus 10 may be arranged to apply fluid to the first side $\mathbf{26}_1$ and to the second side $\mathbf{26}_2$ of the substrate 26.

The first roller 14 may also be referred to as a first impression drum. The first roller 14 is arranged to rotate anti-clockwise about an axis and to receive fluid from the first fluid applicator 16.

Figure 2:
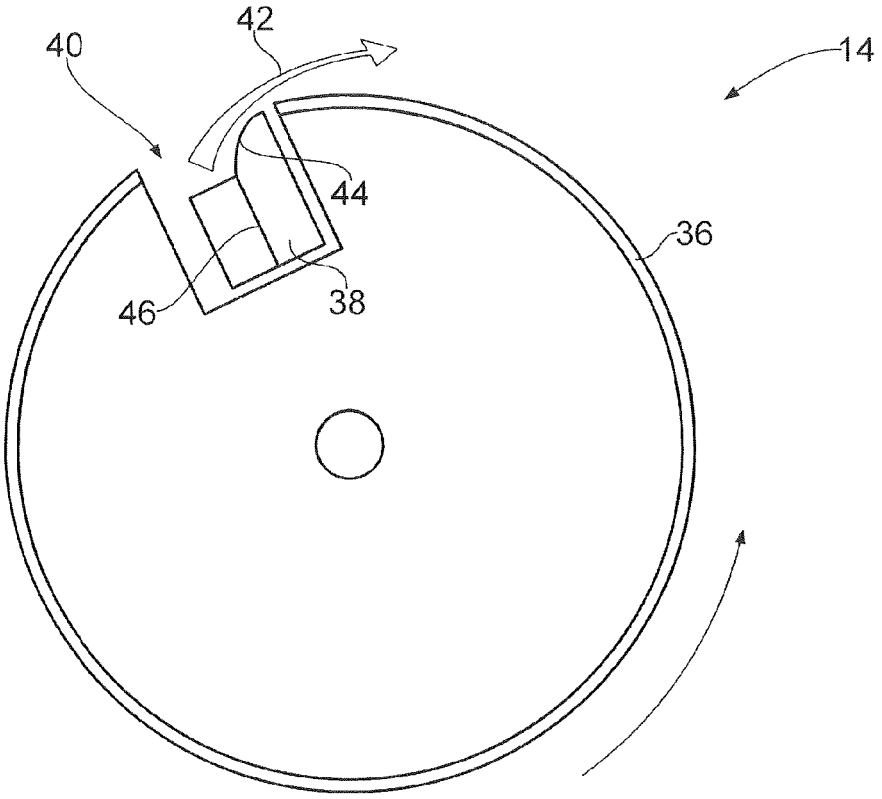
FIG. 2 illustrates a cross sectional side view of a roller according to an example.

In more detail, FIG. 2 illustrates a cross sectional side view of the first roller 14 according to an example. The first roller 14 has a cylindrical shape and includes an exterior surface 36 and an outlet 38. The exterior surface 36 is arranged to receive fluid from the first fluid applicator 16 and to apply the fluid to the substrate 26. The exterior surface 36 may comprise any suitable material for transferring the fluid to the substrate 26. For example, the exterior surface 36 may comprise rubber.

The exterior surface 36 defines a slot 40 (which may also be referred to as a 'seam zone') that extends along at least a portion of the length of the first roller 14. The slot 40 is sized and shaped to receive the outlet 38 therein so that the outlet 38 does not protrude radially outwards beyond the exterior surface 36.

The outlet 38 may also be referred to as an 'air knife' and is positioned within the slot 40 of the first roller 14. The outlet 38 is arranged to direct gas flow towards the substrate 26 between predetermined angular positions of the first roller 14. The outlet 38 may be arranged to provide any suitable gas for supporting and drying the substrate 26. For example, the outlet 38 may be coupled to a source of compressed air, or may be coupled to another source of compressed gas that is suitable for drying fluid on the substrate 26. In some examples, the gas provided by the outlet 38 may be pre-heated to increase the rate at which the fluid dries on the substrate 26.

The outlet 38 is arranged to provide gas outwardly from the first roller 14 and includes a curved surface 44 that extends from an opening 46 of the outlet 38 to the exterior surface 36. The curved surface 44 is arranged to direct the gas 42 from the opening 46 of the outlet 38 along the exterior surface 36 of the first roller 14 (using the Coanda effect).

The controller 12 is arranged to control the operation of the first roller 14. In particular, the controller 12 is arranged to control the rotation of the first roller 14 and to control the provision of gas from the outlet 38.

Returning to FIG. 1, the first fluid applicator 16 may include an applicator roller $\mathbf{16}_1$ that is arranged to rotate clockwise about an axis, and a spray $\mathbf{16}_2$ for providing the fluid to the applicator roller $\mathbf{16}_1$. The applicator roller $\mathbf{16}_1$ is positioned adjacent to the first roller 14 so that as the applicator roller $\mathbf{16}_1$ rotates, fluid is transferred from the applicator roller $\mathbf{16}_1$ to the first roller 14. The first roller 14 is arranged to apply the fluid to the first side $\mathbf{26}_1$ of the substrate 26.

The controller 12 is arranged to control the operation of the first fluid applicator 16. In particular, the controller 12 is arranged to control the provision of fluid from the spray $\mathbf{16}_2$ and to control the rotation of the applicator roller $\mathbf{16}_1$.

The second roller 18 may be referred to as a second impression drum and has the same structure as the first roller 18 (that is, the second roller 18 has the structure illustrated in FIG. 2). The second roller 18 is arranged to rotate clockwise about an axis and is positioned adjacent the first roller 14 to form a nip 47 there between. The first roller 14 and the second roller 18 are arranged to receive the substrate 26 in the nip 47 to apply fluid to the substrate 26.

The second fluid applicator 20 may include an applicator roller $\mathbf{20}_1$ that is arranged to rotate anti-clockwise about an axis, and a spray $\mathbf{20}_2$ for providing the fluid to the applicator roller $\mathbf{20}_1$. The applicator roller $\mathbf{20}_1$ is positioned adjacent the second roller 18 so that as the applicator roller $\mathbf{20}_1$ rotates, fluid is transferred from the applicator roller $\mathbf{20}_1$ to the second roller 18. The second roller 18 is arranged to apply the fluid to the second side $\mathbf{26}_2$ of the substrate 26.

The controller 12 is arranged to control the operation of the second fluid applicator 20 and the second roller 18. In particular, the controller 12 is arranged to control the provision of fluid from the spray $\mathbf{20}_2$ and to control the rotation of the applicator roller $\mathbf{20}_1$ and the second roller 18.

The guide module 22 is arranged to receive the substrate 22 from the first and second rollers 14, 18. The guide module 22 is arranged to provide gas to the substrate 26 to dry the fluid applied to the substrate 26 and to transport the substrate 26 in a contactless manner to the conveyor 24. The guide module includes a chamber 48 in which outlets provide a cushion of gas to transport and dry the substrate 26. In particular, the guide module may be arranged to provide gas to the first side $\mathbf{26}_1$ and to the second side $\mathbf{26}_2$ of the substrate 26.

Figure 3:
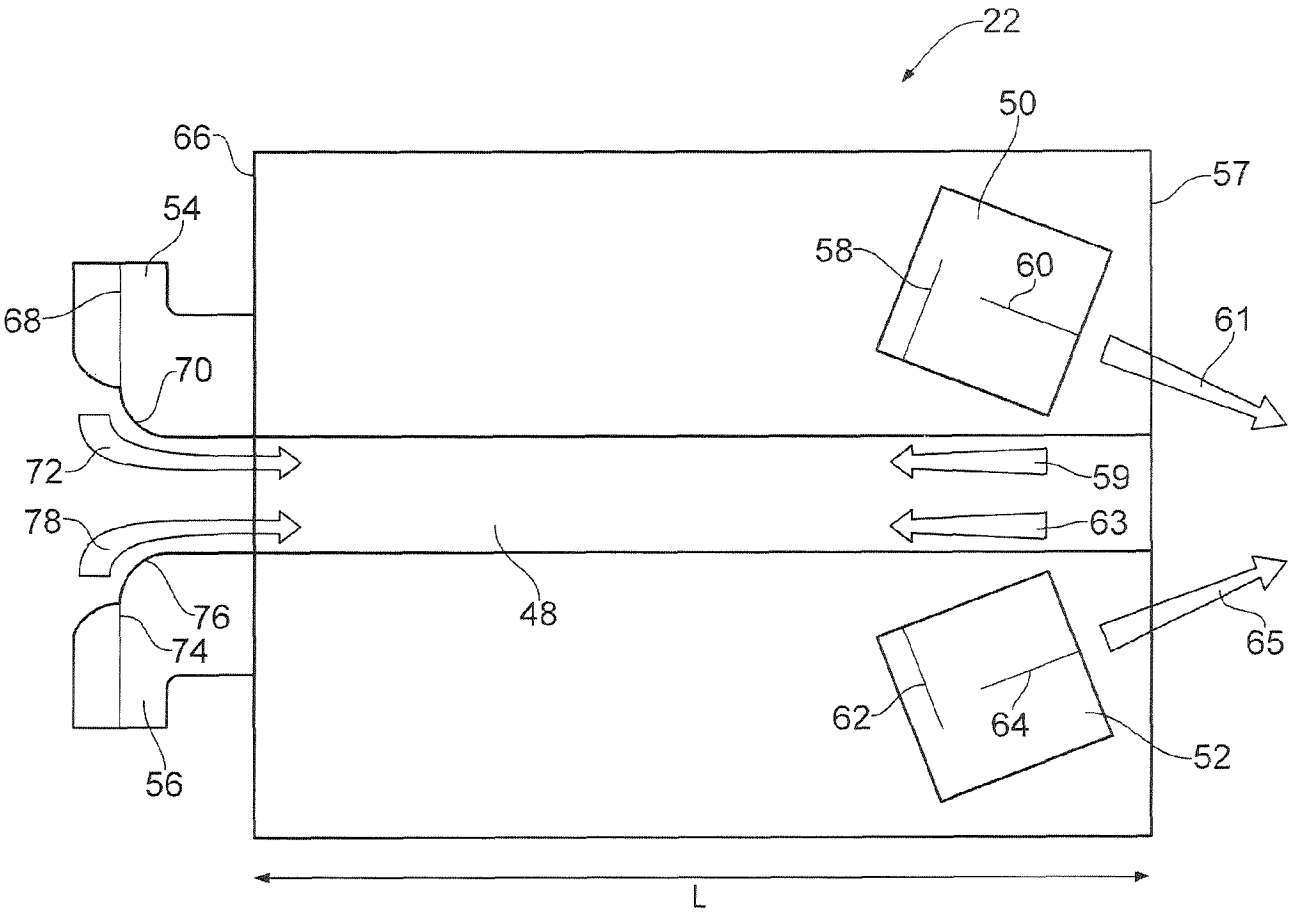
FIG. 3 illustrates a cross sectional side view of a guide module according to an example.

FIG. 3 illustrates a cross sectional side view of the guide module 22 according to an example. The guide module 22 includes the chamber 48, a first outlet 50, a second outlet 52, a third outlet 54 and a fourth outlet 56. As illustrated in FIG. 1, the chamber 48 is aligned with the nip 47 formed between the first roller 14 and the second roller 18 to receive the substrate 26. The chamber 48 has a length L through which the substrate 26 is transported. The length of the chamber 48 may be selected to enable the guide module 22 to wholly dry the fluid applied to the substrate 26.

The first, second, third and fourth outlets 50, 52, 54 and 56 may be arranged to provide any suitable gas to transport the substrate 26 and to dry the fluid on the substrate 26. For example, the first, second, third and fourth outlets 50, 52, 54, and 56 may be coupled to a source of compressed air. In some examples, the gas provided by the outlets 50, 52, 54, and 56 may be pre-heated to increase the rate at which fluid on the substrate 26 dries. The outlets 50, 52, 54, and 56 may also be referred to as 'air knives'.

The first outlet 50 is positioned above the chamber 48 towards a first end 57 of the guide module 22. The first end 57 of the guide module 22 is positioned adjacent the first and second rollers 14, 18. The first outlet 50 includes a first opening 58 and a second opening 60 for providing gas. The first opening 58 is oriented towards the chamber 48 so that gas provided by the first opening forms an upper gas cushion 59 within the chamber 48. The second opening 60 is oriented towards the nip 47 formed between the first roller 14 and the second roller 16 to provide gas 61 towards the nip 47.

The second outlet 52 is positioned below the chamber 48 at the first end 57 of the guide module 22. The second outlet 52 includes a first opening 62 and a second opening 64 for providing gas. The first opening 62 is oriented towards the chamber 48 so that gas provided by the first opening forms a lower gas cushion 63 within the chamber 48. The second opening 60 is oriented towards the nip 47 formed between the first roller 14 and the second roller 16 to provide gas 65 towards the nip 47.

The pressure provided by the upper gas cushion 59 on the substrate 26 and the pressure provided by the lower gas cushion 63 on the substrate 26 are selected so that the substrate 26 may be transported within the chamber 48 without contacting the side walls of the top and bottom surfaces of the chamber 48. For example, the pressure provided by the upper gas cushion 59 and the pressure provided by the lower gas cushion 63 may be substantially the same to prevent the substrate 26 from contacting the walls of the chamber 48.

The pressure provided by the gas flow 61 from the opening 60 on the substrate 26, and the pressure provided by the gas flow 65 from the opening 64 on the substrate 26, are selected so that the substrate 26 may be supported as the substrate 26 emerges from the nip 47 between the first roller 14 and the second roller 14. For example, the pressure provided by the gas 61 and the gas 65 may be substantially the same to support the substrate 26 in a desired orientation (horizontal for example) and enable the substrate 26 to enter the chamber 48.

The third outlet 54 is positioned above the chamber 48 towards a second end 66 of the guide module 22. The second end 66 is opposite the first end 57 and is adjacent to the conveyor 24. The third outlet 54 includes an opening 68 and a curved surface 70 that extends from the opening 68 towards the chamber 48. The opening 68 is arranged to provide gas flow 72 that is directed to the chamber 48 due to the Coanda effect caused by the curved surface 70. The gas flow 72 forms an upper gas cushion within the chamber 48.

The fourth outlet 56 is positioned below the chamber 48 at the second end 66 of the guide module 22. The fourth outlet 56 includes an opening 74 and a curved surface 76 that extends from the opening 74 towards the chamber 48. The opening 74 is arranged to provide gas flow 78 that is directed to the chamber 48 due to the Coanda effect caused by the curved surface 76. The gas flow 78 forms a lower gas cushion within the chamber 48.

In some examples, the third outlet 54 and the fourth outlet 56 may not be arranged to provide gas flow 72, 78 using the Coanda effect. In these examples, the openings 68, 74 may be oriented parallel to the chamber 48 to direct the gas flow 72, 78 parallel to, and into, the chamber 48.

The pressure provided by the upper gas cushion 72 on the substrate 26 and the pressure provided by the lower gas cushion 78 on the substrate 26 are selected so that the substrate 26 may be transported within the chamber 48 without contacting the walls of the chamber 48. For example, the pressure provided by the upper gas cushion 72 and the pressure provided by the lower gas cushion 78 may be substantially the same to prevent the substrate 26 from contacting the walls of the chamber 48.

Returning to FIG. 1, the conveyor 24 is arranged to receive the substrate 26 from the guide module 22 and to convey the substrate to an out tray or a further device. For example, where the apparatus 10 is arranged to coat the substrate 26 with a primer, the conveyor 24 may be arranged to transport the substrate 26 to a printer. In some examples, the conveyor 24 may include at least two rollers that form a nip for transporting the substrate 26.

The implementation of the controller 12 can be in hardware alone (for example, a circuit, a processor and so on), have certain aspects in software including firmware alone or can be a combination of hardware and software (including firmware).

The controller 12 may be implemented using instructions that enable hardware functionality, for example, by using executable computer program instructions in a general-purpose or special-purpose processor that may be stored on a computer readable storage medium (disk, memory etc) to be executed by such a processor. Consequently, the controller 12 may include one or multiple processors 28, and one or multiple memories 30.

The processor 28 is configured to read from and write to the memory 30. The processor 28 may also comprise an output interface via which data and/or commands are output by the processor 28 and an input interface via which data and/or commands are input to the processor 28.

The memory 30 stores a computer program 32 comprising computer program instructions that control the operation of the apparatus 10 when loaded into the processor 28. The computer program instructions 32 provide the logic and routines that enable the apparatus 10 to perform the methods illustrated in FIG. 4 and described in the paragraphs of the detailed description. The processor 28 by reading the memory 30 is able to load and execute the computer program 32.

The apparatus 10 therefore comprises: one or multiple processors 28; and one or multiple memories 30 including computer program code 32, the one or multiple memories 30 and the computer program code 32 configured to, with the one or multiple processors 28, cause the apparatus 10 at least to perform the methods illustrated in FIG. 4 and described in the paragraphs below.

The computer program 32 may arrive at the apparatus 10 via any suitable delivery mechanism 34. The delivery mechanism 34 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 32. The delivery mechanism 34 may be a signal configured to reliably transfer the computer program 32. The apparatus 10 may propagate or transmit the computer program 32 as a computer data signal.

The operation of the apparatus 10 is described in the following paragraphs with reference to FIGS. 4, 5, 6 and 7.

Figure 4:
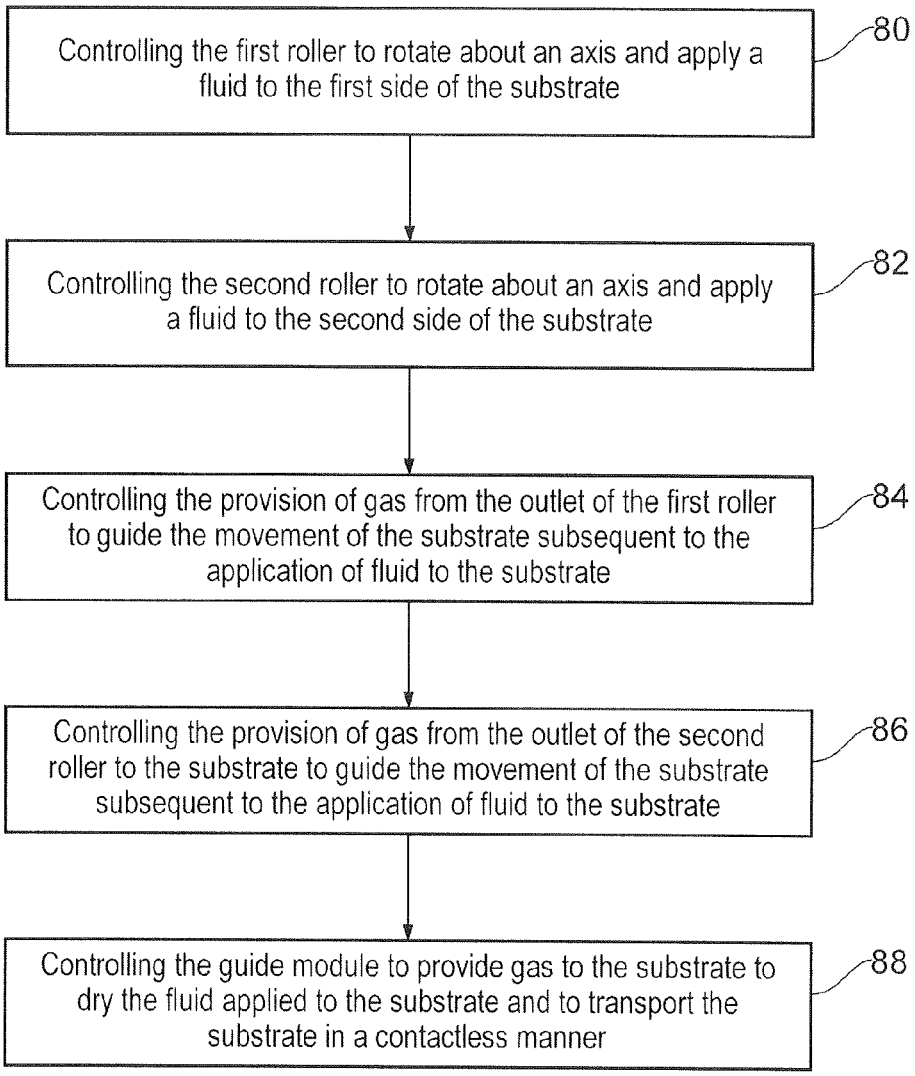
FIG. 4 illustrates a flow diagram of a method to apply a fluid to a substrate according to an example.

FIG. 4 illustrates a flow diagram of a method to apply a fluid to the substrate 26.

At block 80, the controller 12 controls the first roller 14 to rotate about an axis and apply a fluid to the first side $\mathbf{26}_1$ of the substrate 26. For example, the controller 12 may control the spray $\mathbf{16}_2$ to spray fluid on the applicator roller $\mathbf{16}_1$, and also control the applicator roller $\mathbf{16}_1$ and the first roller 14 to rotate about their respective axes so that fluid is transferred from the spray $\mathbf{16}_2$ to the first side $\mathbf{26}_1$ of the substrate 26 via the applicator roller $\mathbf{16}_1$ and the first roller 14.

At block 82, the controller 12 controls the second roller 18 to rotate about an axis and apply a fluid to the second side $\mathbf{26}_2$ of the substrate 26. For example, the controller 12 may control the spray $\mathbf{20}_2$ to spray fluid on the applicator roller $\mathbf{20}_1$, and also control the applicator roller $\mathbf{20}_1$ and the second roller 18 to rotate about their respective axes so that fluid is transferred from the spray $\mathbf{20}_2$ to the second side $\mathbf{26}_2$ of the substrate 26 via the applicator roller $\mathbf{20}_1$ and the second roller 18.

At blocks 80 and 82, the controller 12 is arranged to synchronise the rotation of the first and second rollers 14, 18 with the movement of the substrate 26. For example, the apparatus 10 controls the movement of the substrate 26 and the first and second rollers 14, 18 so that the leading edge of the substrate 26 enters the nip 47 between the slots 40 of the first and second rollers 14, 18. Consequently, fluid may not be applied to the leading edge of the substrate 26 in these examples.

Figure 5:
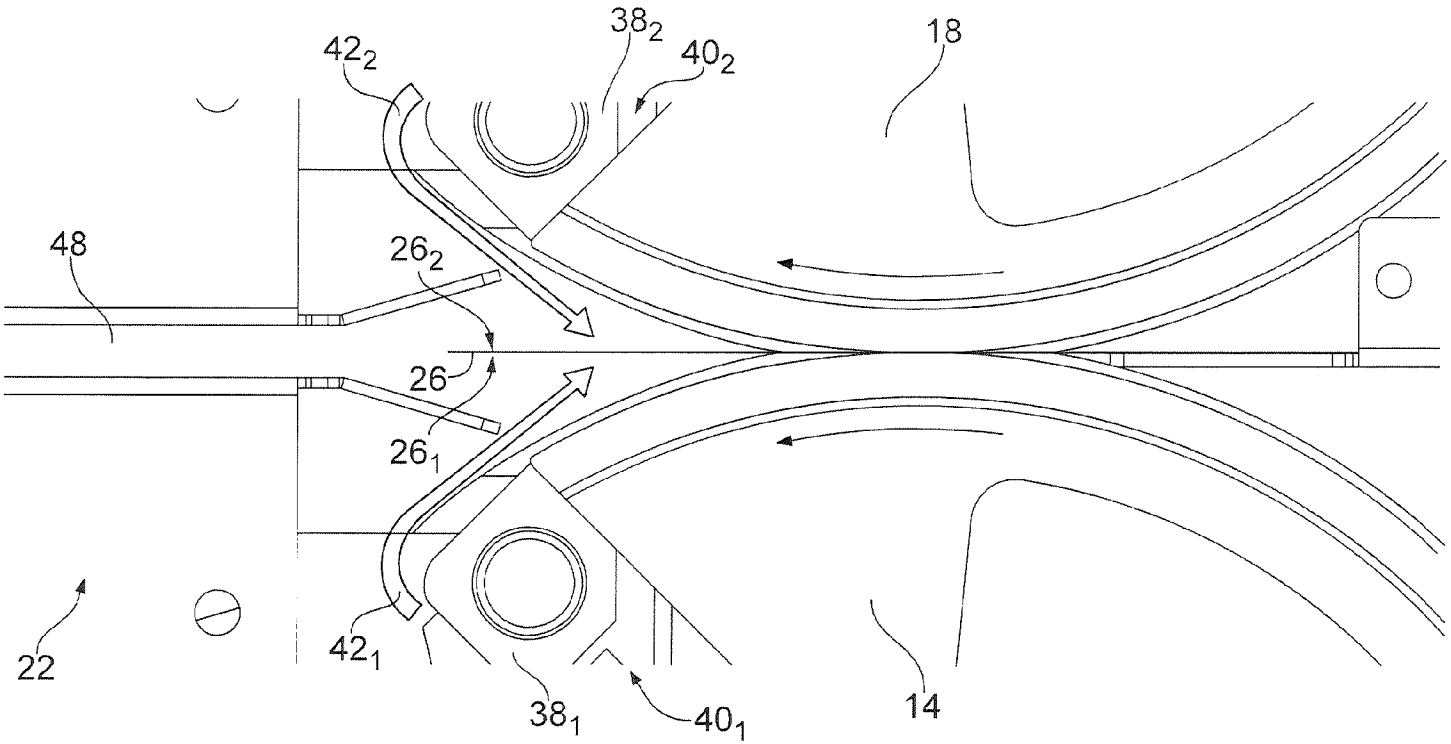
FIG. 5 illustrates a first cross sectional side view of the apparatus illustrated in FIGS. 1, 2 and 3.

At block 84, the controller 12 controls the provision of gas from the outlet $\mathbf{38}_1$ of the first roller 14 to guide the movement of the substrate 26 subsequent to the application of fluid to the substrate 26. As illustrated in FIG. 5, the outlet $\mathbf{38}_1$ of the first roller 14 provides gas $\mathbf{42}_1$ toward the first side $\mathbf{26}_1$ of the substrate 26 as the substrate 26 emerges from the nip 47 between the first roller 14 and the second roller 18.

At block 86, the controller 12 controls the provision of gas from the outlet $\mathbf{38}_2$ of the second roller 18 to guide the movement of the substrate 26 subsequent to the application of fluid to the substrate 26. As illustrated in FIG. 5, the outlet $\mathbf{38}_2$ of the second roller 18 provides gas $\mathbf{42}_2$ toward the second side $\mathbf{26}_2$ of the substrate 26 as the substrate 26 emerges from the nip 47 between the first roller 14 and the second roller 18.

The pressures provided by the gas $\mathbf{42}_1$ and the gas $\mathbf{42}_2$ on the substrate 26 are selected so that the substrate 26 may be transported to the guide module 22 and enter the chamber 48. Additionally, the pressures provided by the gas $\mathbf{42}_1$ and the gas $\mathbf{42}_2$ on the substrate 26 prevent the substrate 26 from adhering to the first roller 14 and the second roller 18 respectively.

In some examples, the controller 12 may control the provision of gas from the outlet $\mathbf{38}_1$ while the first roller 14 is rotated from a first predetermined angle to a second predetermined angle so that gas is only provided while the first roller 14 is between the first and second predetermined angles. For example, the controller 12 may initiate the provision of gas from the outlet $\mathbf{38}_1$ of the first roller 14 when the slot $\mathbf{40}_1$ is positioned at the nip 47 between the first roller 14 and the second roller 18 (that is, the first predetermined angle). The controller 12 may then control the provision of gas from the outlet $\mathbf{38}_1$ until the slot $\mathbf{40}_1$ has rotated through forty five degrees (that is, the second predetermined angle) and the controller 12 then stops the provision of gas from the outlet $\mathbf{38}_1$.

Similarly, the controller 12 may control the provision of gas from the outlet $\mathbf{38}_2$ while the second roller 18 is rotated from a first predetermined angle to a second predetermined angle so that gas is only provided while the second roller 18 is between the first and second predetermined angles. For example, the controller 12 may initiate the provision of gas from the outlet $\mathbf{38}_2$ of the second roller 18 when the slot $\mathbf{40}_2$ is positioned at the nip 47 between the first roller 14 and the second roller 18 (that is, the first predetermined angle). The controller 12 may then control the provision of gas from the outlet $\mathbf{38}_2$ until the slot $\mathbf{40}_2$ has rotated through forty five degrees (that is, the second predetermined angle) and the controller 12 then stops the provision of gas from the outlet $\mathbf{38}_2$.

Figure 6:
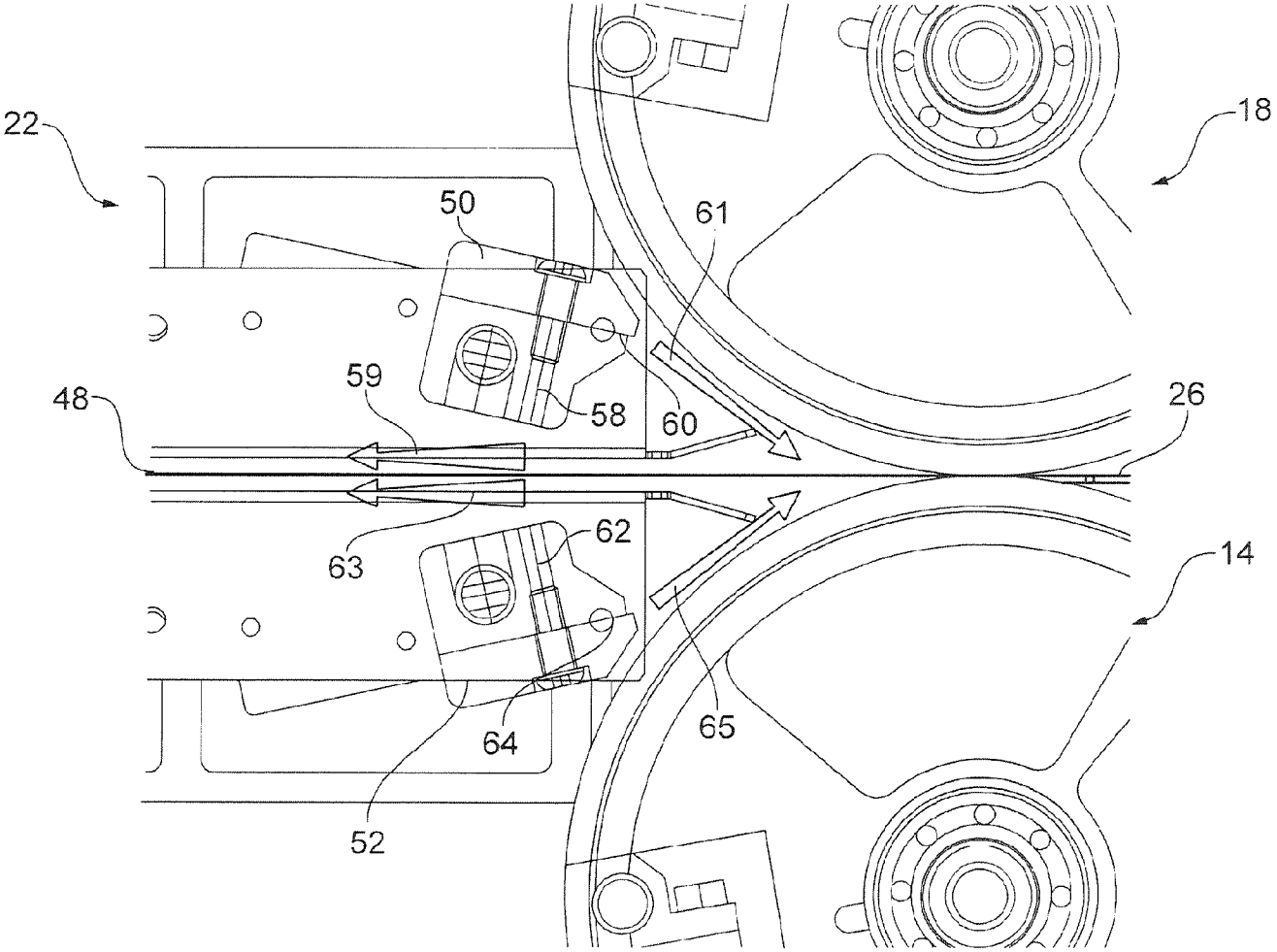
FIG. 6 illustrates a second cross sectional side view of the apparatus illustrated in FIGS. 1, 2, 3 and 5.

At block 88, the controller 12 controls the guide module 22 to provide gas to the substrate 26 to dry the fluid applied to the substrate 26 and to transport the substrate 26 in a contactless manner through the guide module 22. As illustrated in FIG. 6, the controller 12 controls the first outlet 50 to provide gas to form the gas cushion 59, and controls the second outlet 52 to provide gas to form the gas cushion 63. Additionally, the controller 12 may control the first outlet 50 to provide gas 61 towards the substrate 26, and control the second outlet 52 to provide gas 65 towards the substrate 26. In some examples, the controller 12 may control the guide module 22 to initiate the provision of gas when the first and second rollers 14, 18 rotate to the second predetermined angle.

Figure 7:
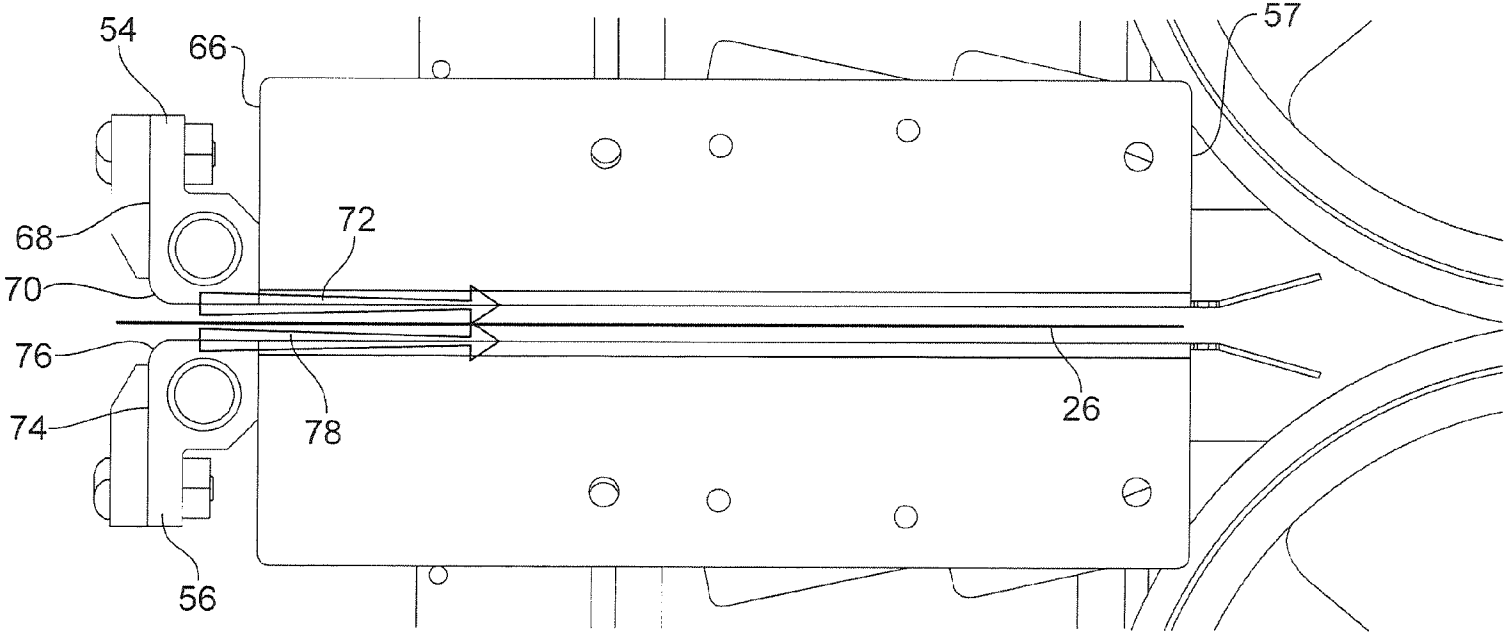
FIG. 7 illustrates a third cross sectional side view of the apparatus illustrated in FIGS. 1, 2, 3, 5 and 6.

As illustrated in FIG. 7, the controller 12 also controls the third outlet 54 to provide gas to form the upper gas cushion 72 and controls the fourth outlet 56 to provide gas to form the lower gas cushion 78. The controller 12 may initiate the provision of gas from the third outlet 54 and the fourth outlet 56 when the substrate 26 is being conveyed by the conveyor 24.

The apparatus 10 may provide several advantages. Firstly, the gas provided by the outlets 38 of the first and second rollers 14, 18 advantageously prevent the substrate 26 from adhering to the first and second rollers 14, 18. Secondly, the apparatus 10 is arranged to apply fluid to both sides of the substrate 26 and then transport the substrate 26 contactlessly so that the applied fluid is not removed from, or smeared on, the substrate 26. As a consequence, the fluid may be applied more uniformly across the surfaces of the substrate 26 and may improve the print quality on the substrate 26.

Thirdly, the apparatus 10 may require less cleaning due to the contactless transportation of the substrate 26.

The blocks illustrated in the FIG. 4 may represent steps in a method and/or sections of code in the computer program 32. The illustration of a particular order to the blocks does not necessarily imply that there is a required or preferred order for the blocks and the order and arrangement of the block may be varied in some examples. Furthermore, it may be possible for some blocks to be omitted in some examples.

Figure 8:
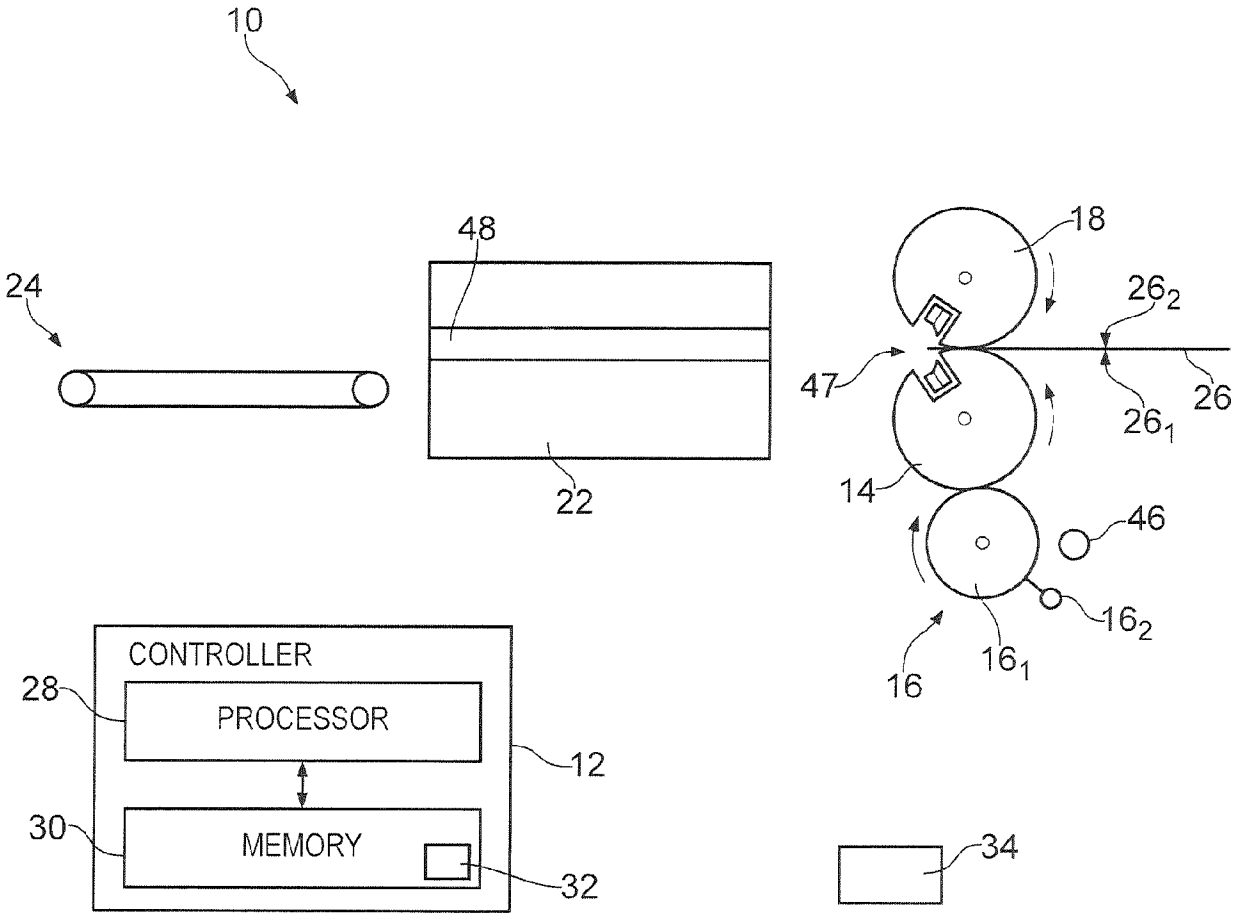
FIG. 8 illustrates a schematic diagram of another apparatus to apply a fluid to a substrate according to an example.

Although examples of the present invention have been described in the preceding paragraphs, it should be appreciated that modifications to the examples given can be made without departing from the scope of the invention as claimed. For example, as illustrated in FIG. 8, the apparatus 10 may not include the second fluid applicator 20 and consequently, the second roller 18 does not apply fluid to the second side $\mathbf{26}_2$ of the substrate 26 in these examples.

Although the memory 30 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) combinations of circuits and software (and/or firmware), such as (as applicable): (i) a combination of processor(s) or (ii) portions of processor(s)/software (including digital signal processor(s)), software, and memory(ies) that work together to cause an apparatus to perform various functions) and (c) circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. Apparatus to apply a fluid to a substrate, the apparatus comprising:

a first roller to rotate about an axis and apply a fluid to a first side of the substrate, the first roller including an outlet to provide gas to the substrate to guide a movement of the substrate subsequent to the application of fluid to the substrate; and a second roller to rotate about an axis, the second roller being positioned adjacent to the first roller to form a nip, the second roller including an outlet to provide gas to the substrate to guide the movement of the substrate subsequent to the application of fluid to the substrate.

2. Apparatus as claimed in claim 1, wherein the first roller has an exterior surface to apply the fluid to the first side of the substrate, the exterior surface defining a slot therein, the outlet being positioned within the slot.

3. Apparatus as claimed in claim 1 wherein the second roller is to apply a fluid to a second side of the substrate.

4. Apparatus as claimed in claim 1, further comprising a guide module to receive the substrate from the first roller, the guide module being arranged to provide gas to the substrate to dry the fluid applied to the substrate and to transport the substrate in a contactless manner.

5. Apparatus as claimed in claim 4, wherein the guide module includes a chamber to transport the substrate, the chamber having a length selected to enable the guide module to wholly dry the fluid applied to the substrate.

6. Apparatus as claimed in claim 4, wherein the guide module is to provide gas at least toward the first roller to support the substrate subsequent to the application of the fluid to the substrate.

7. A method to apply a fluid to a substrate, the method comprising:

controlling a first roller to rotate about an axis and apply a fluid to a first side of the substrate;

controlling provision of gas from an outlet of the first roller to guide a movement of the substrate subsequent to the application of fluid to the substrate;

controlling a second roller to rotate about an axis, the second roller being positioned adjacent to the first roller to form a nip; and controlling provision of gas from an outlet of the second roller to the substrate to guide the movement of the substrate subsequent to the application of fluid to the substrate.

8. A method as claimed in claim 7, wherein controlling the provision of gas from the outlet is performed while the first roller is rotated from a first predetermined angle to a second predetermined angle.

9. A method as claimed in claim 7, further comprising controlling a guide module to provide gas to the substrate to dry the fluid applied to the substrate and to transport the substrate in a contactless manner, the guide module being arranged to receive the substrate from the first roller.

10. Apparatus to apply fluid to a substrate, the apparatus comprising:

a controller to:

control a first roller to rotate about an axis and apply a fluid to a first side of the substrate;

control the provision of gas from an outlet of the first roller to guide a movement of the substrate subsequent to the application of fluid to the substrate;

control a second roller to rotate about an axis, the second roller being positioned adjacent to the first roller to form a nip; and control provision of gas from an outlet of the second roller to the substrate to guide the movement of the substrate subsequent to the application of fluid to the substrate.

11. Apparatus as claimed in claim 10, wherein the controller is to control the provision of gas from the outlet while the first roller is rotated from a first predetermined angle to a second predetermined angle.

12. Apparatus as claimed in claim 10, wherein the controller is to: control a guide module to provide gas to the substrate to dry the fluid applied to the substrate and to transport the substrate in a contactless manner, the guide module being arranged to receive the substrate from the first roller.

13. Apparatus as claimed in claim 1, wherein the outlet of the first roller includes an opening to provide gas to the substrate and a curved surface extending from the opening of the outlet towards an exterior surface of the first roller to guide the movement of the substrate.

* * * * *